US005964104A

United States Patent [19]

Rottmann

[11] Patent Number: 5,964,104

[45] Date of Patent: Oct. 12, 1999

[54] METHOD AND DEVICE FOR OBTAINING NITROGEN BY LOW-TEMPERATURE SEPARATION OF AIR

[75] Inventor: Dietrich Rottmann, Munich, Germany

[73] Assignee: Linde Aktiengesellschaft, Wiesbaden, Germany

[21] Appl. No.: 09/079,236

[22] Filed: May 15, 1998

[30] Foreign Application Priority Data

May 15, 1997 [DE] Germany ..... 197 20 453

[51] Int. Cl.[6] ..... F25J 3/00

[52] U.S. Cl. ..... 62/650; 62/652

[58] Field of Search ..... 62/650, 652

[56] References Cited

U.S. PATENT DOCUMENTS

| | | | |
|---|---|---|---|
| 4,099,945 | 7/1978 | Skolaude . | |
| 4,299,607 | 11/1981 | Okabe | 62/650 |
| 4,617,036 | 10/1986 | Suchdeo et al. . | |
| 4,834,785 | 5/1989 | Ayres | 62/650 |
| 5,651,271 | 7/1997 | Fraysse | 62/650 |

OTHER PUBLICATIONS

Derwent WPI Abstract of 44 41 920 C1, D. Rottmann, Jul. 11, 1996.

Derwent WPI Abstract of 25 48 222 B, Jan. 27, 1977.

Derwent WPI Abstract of 35 28 374 A, D. Rottmann, Feb. 12, 1987.

*Primary Examiner*—Ronald Capossela

*Attorney, Agent, or Firm*—Evenson, McKeown Edwards & Lenahan P.L.L.C.

[57] ABSTRACT

In the method and device, nitrogen is obtained by two-stage rectification of air in a double column. Double column contains a high-pressure column and a medium-pressure column that are in a heat-exchange relationship with each other. Entering air is compressed, purified, cooled in a main heat exchanger against separation products, and fed to rectification. At least one nitrogen product fraction is taken from high-pressure column. A nitrogen gas fraction from double column is heated, expanded, and brought into indirect heat exchange with an oxygen-enriched liquid from the lower region of medium-pressure column. In this way, the nitrogen gas fraction is at least partially condensed and the oxygen-enriched liquid is at least partially evaporated. The condensate formed in the indirect heat exchange is at least partially fed to medium-pressure column. The nitrogen gas fraction is heated upstream of expansion to an intermediate temperature that is between the temperatures at the cold end and the warm end of main heat exchanger.

13 Claims, 2 Drawing Sheets

METHOD AND DEVICE FOR OBTAINING NITROGEN BY LOW-TEMPERATURE SEPARATION OF AIR

BACKGROUND AND SUMMARY OF THE INVENTION

This application claims the priority of German patent 197 20 453.8, filed May, 15, 1997, in Germany, the disclosure of which is expressly incorporated by reference herein.

The present invention relates to a method and device for obtaining nitrogen by low-temperature separation of air by two-stage rectification in a double column. The double column has a high-pressure column and a medium-pressure column that are in a heat-exchange relationship with each other. In the process, air is compressed, purified, and cooled in a main heat exchanger against separation products, and fed to rectification. At least one nitrogen product fraction is removed from the high-pressure column and a nitrogen gas fraction from the double column is heated, expanded, and at least partially brought into indirect heat exchange with an oxygen-enriched liquid from the lower region of the medium-pressure column. The nitrogen gas fraction is at least partially condensed and the oxygen-enriched liquid is at least partially evaporated, and the condensate formed in the indirect heat exchange is at least partially recycled to the medium-pressure column.

The basic information for low-temperature separation of air in general and the construction of double-column systems in particular is known from the monograph entitled "Tieftemperaturtechnik" ("Low-Temperature Technology") by Hausen/Linde (Second Edition, 1985) or from a paper by Latimer in Chemical Engineering Progress (Vol. 63, No. 2, 1967, p. 35). The heat-exchange relationship between the high-pressure column and the medium-pressure column of a double column is generally brought about in a main condenser, in which head gas in the high-pressure column is liquefied against evaporating bottom liquid in the medium-pressure column.

A method of this type is disclosed in DE 4441920 Cl. In this reference, the nitrogen gas fraction is formed by head gas in the medium-pressure column. Before it is expanded, it is first heated to ambient temperature then compressed and cooled again. This method is not economically satisfactory in all cases.

Hence the goal of the present invention is to provide a method and corresponding device for the separation of air having especially high economy, particularly through low energy consumption and/or low equipment cost.

This goal is achieved by heating the nitrogen gas fraction upstream of expansion to an intermediate temperature between the temperatures of the cold end and the warm end of the main heat exchanger.

Heating of the nitrogen gas fraction is usually effected by indirect heat exchange. It can occur for example in the main heat exchanger used to cool entering air. According to the present invention, heating of the nitrogen gas fraction from the intermediate temperature to the temperature at the warm end of the main heat exchanger (usually approximately the same as ambient temperature) and the corresponding re-cooling are at least partially unnecessary. Exchange losses in the corresponding heat exchanger are correspondingly lower, i.e. less energy is lost by irreversibilities. The corresponding heat exchanger can also have fewer passages and accordingly can be manufactured more economically.

The intermediate temperature to which the nitrogen gas fraction is heated is, for example, 140 to 190 K less than the temperature of the warm end of the main heat exchanger. Expansion of the nitrogen gas fraction upstream of its condensation by indirect heat exchange preferably leads to a pressure intermediate between the pressures of the high-pressure column and the medium-pressure column or to a pressure below the pressure of the medium-pressure column. Accordingly, the pressure of the condensate before it is fed into the medium-pressure column has to be decreased or increased, for example, by a throttle valve or a pump.

Preferably, the nitrogen gas fraction is not cooled between being heated to an intermediate temperature and being expanded. Hence, there are no irreversibilities due to heating and re-cooling of the nitrogen gas fraction and the corresponding heat exchange devices.

Moreover, it is preferable for the nitrogen gas fraction to come from the high-pressure column. In this case in particular, the nitrogen gas fraction does not need to be compressed between heating to the intermediate temperature and expansion, so that the corresponding machine and its associated energy consumption are unnecessary.

If some of the condensate formed in the indirect heat exchange is fed to the high-pressure column, the corresponding quantity can additionally be obtained as a high-pressure product from the high-pressure column. To increase the pressure in the condensate to the high-pressure column level, a pump for example may be used.

Any known method may be used to expand the nitrogen gas fraction, but this expansion is preferably effected in a work-producing manner, for example in a turbine. In this way, some or all of the cold needed for the process can be obtained. Additionally, it is possible to use the energy obtained from expansion at least partially to compress a product stream, for example by mechanical coupling of the expansion machine to a compressor.

Particularly for the case that the expanded quantity of nitrogen gas fraction is so large that it cannot be completely liquefied against the oxygen-enriched liquid, it is favorable for some of the expanded nitrogen gas fraction to be condensed in indirect heat exchange with an intermediate liquid from the medium-pressure column. This avoids raising the input pressure when the nitrogen gas fraction is expanded, even with a relatively high cold requirement. The condensate arising from this indirect heat exchange is preferably fed to the medium-pressure column. The gas produced when the intermediate liquid is evaporated is preferably recycled into the medium-pressure column. The addition heating of the medium-pressure column thus produced improves the separating effect of this column. The corresponding additional condenser-evaporator can be located inside or outside the medium-pressure column.

The intermediate liquid is preferably drawn off in an region below the point at which sump liquid is fed to the high-pressure column, and at least one, preferably 1 to 30, for example 20, theoretical levels or trays above the medium-pressure column sump.

BRIEF DESCRIPTION OF THE DRAWINGS

The invention and further details of the invention are described in greater detail hereinbelow with the aid of the embodiments shown schematically in the drawings.

Figure 1:
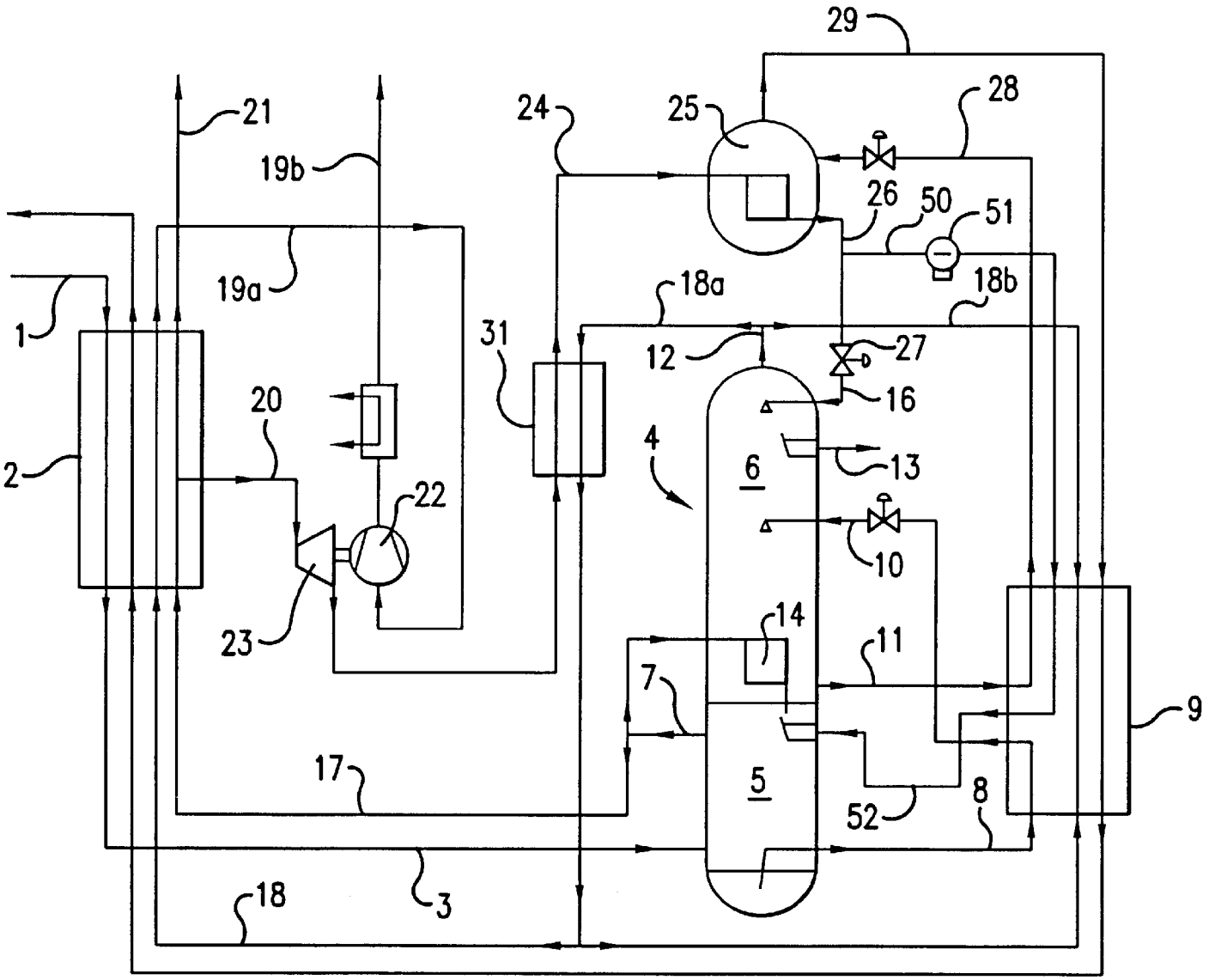
FIG. 1 is a preferred embodiment of the method and device according to the invention.

Other objects, advantages and novel features of the present invention will become apparent from the following detailed description of the invention when considered in conjunction with the accompanying drawings.

DETAILED DESCRIPTION OF PREFERRED EMBODIMENTS

Air 1, compressed and purified in a molecular sieve station, flows through a main heat exchanger 2 and is fed through line 3 into a double column 4, specifically into its high-pressure column 5. Oxygen-enriched liquid 8 from high-pressure column 5 is forced after supercooling 9 via line 10 into medium-pressure column 6. Some of head fraction 7 in the high-pressure column is fed through a main condenser 14, where it is condensed, and is preferably completely recycled to high-pressure column 5. Another partial stream 17 of head fraction 7 is fed to main heat exchanger 2. Here, the first part of it is heated to approximately ambient temperature and drawn off as a high-pressure product 21, while a second part 20 is drawn off at an intermediate temperature from main heat exchanger 2 and forms the nitrogen gas fraction according to the present invention, as described in greater detail below. The intermediate temperature is, for example, 175 K lower than the temperature at the warm end of main heat exchanger 2 (approximately ambient temperature).

The liquid in the sump of medium-pressure column 6 enters, via main condenser 14, into heat exchange with the condensing head fraction of the high-pressure column. An oxygen-enriched liquid 11, a gaseous nitrogen stream 12, and possibly liquid nitrogen 13 are removed from medium-pressure column 6. The gaseous nitrogen stream is fed via lines 18*a* and 18*b* and through heat exchangers 9, 31, and 2. It can be drawn off from line 19*a* at approximately ambient temperature as a medium-pressure product or, as shown in the drawing, brought in after-compressor 22 to a further-increased product pressure that leaves as a further high-pressure product 19*b*.

The nitrogen gas fraction is drawn off according to the invention at an intermediate temperature from main heat exchanger 2 (line 20) then expanded in an expansion machine (for example, a turbine) 23 in a work-producing manner.

The work produced by the work-producing expansion machine 23 is transferred, in FIG. 1, by direct mechanical coupling to an after-compressor 22, which compresses a product stream, in this case nitrogen 19*a* from the medium-pressure column. Alternatively, another process stream can be compressed or the mechanical energy can be sent to a generator or a braking blower.

After cooling in heat exchanger 31, the nitrogen gas fraction 24 is fed into the liquefaction chamber of a condenser-evaporator 25. There it enters into indirect heat exchange with oxygen-enriched liquid 28 (which may have been supercooled in 9) from the sump of the medium-pressure column, which is evaporated there, drawn off via line 29, and preferably used for regeneration of the molecular sieve station. The pressure on the evaporation side of head condenser 25 is preferably set, by means of the throttle valve in line 28, such that the overpressure necessary for regeneration of the molecular sieve is present. If necessary, the oxygen-enriched liquid can be pumped by a pump (not shown).

In FIG. 1, only one part 16 of the condensate generated in condenser-evaporator 25 is fed to the medium-pressure column. Another part 50 is fed to pump 51, which brings the liquid to a pressure that is sufficient to deliver it via line 52, possibly after heating in supercooler 9, to high-pressure column 5. Alternatively, the pumped liquid can be evaporated by indirect heat exchange with a gaseous fraction from the high-pressure column or the medium-pressure column and leave as a compressed product (see older international patent application PCT/EP 97/06010) (German Patent applications 19643916.7 and 19717124.9).

The condensate formed in the indirect heat exchange in condenser-evaporator 25 flows back through lines 26 and 16 to medium-pressure column 6. Its pressure is brought to the pressure of medium-pressure column 6. In the example shown, this occurs by means of a throttle valve 27, since the liquefaction chamber is at a higher pressure here than that of the medium-pressure column. Depending on the operating pressure of the medium-pressure column and the composition of the oxygen-enriched liquid 28, the liquefaction chamber of condenser-evaporator 25 can also be operated at a pressure lower than the pressure in the head of medium-pressure column 6. In these cases, the throttle valve is replaced or supplemented by a pump (see DE 4441920 Cl, FIG. 5). When the pressures in the liquefaction chamber of condenser-evaporator 25 and in the head of the medium-pressure column are the same, throttle valve 27 is unnecessary.

In the method, the pressure in the evaporation chamber of head condenser 25 is set by means of the valve in line 28 such that, after evaporation and after passage through heat exchangers 9 and 2 (line 29), the overpressure needed to regenerate the molecular sieve is still available. The quantity of nitrogen (nitrogen gas fraction) needed to evaporate the oxygen-enriched liquid is brought in expansion machine 23 to a pressure that on the one hand is sufficiently high to produce evaporation of the oxygen-enriched liquid against the condensing nitrogen gas fraction 24 in head condenser 25, and on the other hand ensures that the cold requirement for the process is met.

Table 1 shows preferred numerical ranges and a particularly preferred concrete numerical example for the operating pressures in the method according to FIG. 1.

TABLE 1

| | Numerical Range | Example |
|---|---|---|
| Head of high-pressure column 5 | 5.0–9.3 bars | 6.2 bars |
| Head of medium-pressure column 5 | 1.5–4.35 bars | 2.9 bars |
| Inlet expansion machine 23 | 4.3–9.9 bars | 6.1 bars |
| Outlet expansion machine 23 | 3.0–6.0 bars | 4.37 bars |
| Liquefaction side of condenser-evaporator 25 | 3.0–6.0 bars | 4.32 bars |
| Evaporation side of condenser-evaporator 25 | 1.0–3.0 bars | 1.30 bars |

Figure 2:
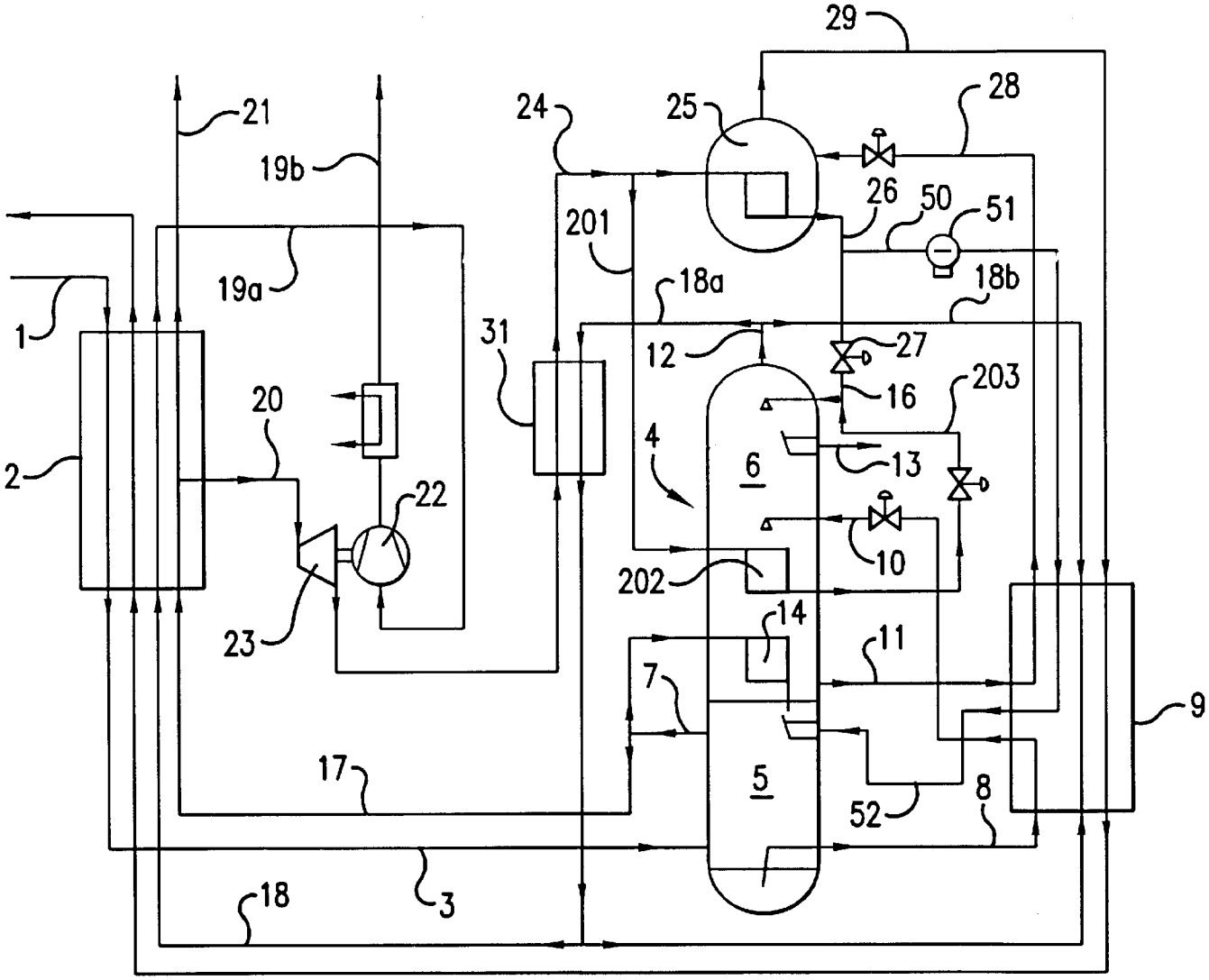
FIG. 2 is a modification of this method with another condenser-evaporator.

FIG. 2 shows a modification of the method and device according to FIG. 1. Corresponding features in the two examples have the same reference numerals, and only the features of the process shown in FIG. 2 that differ are described in detail below.

A part 201 of the expanded nitrogen gas fraction 24 is fed to another condenser-evaporator 202 in FIG. 2 where it is condensed against an intermediate liquid in the medium-pressure column. The oxygen concentration of the intermediate liquid is lower than that in the sump of the medium-pressure column and is at least the same as that of the liquid which prevails where line 10 terminates in the liquid flowing down inside the medium-pressure column. Condensate 203 is sent to the head of medium-pressure column 6.

The foregoing disclosure has been set forth merely to illustrate the invention and is not intended to be limiting.

Since modifications of the disclosed embodiments incorporating the spirit and substance of the invention may occur to persons skilled in the art, the invention should be construed to include everything within the scope of the appended claims and equivalents thereof.

What is claimed is:

1. A method for obtaining nitrogen by low-temperature separation of air by two-stage rectification in a double column that has a high-pressure column and a medium-pressure column that are in a heat-exchange relationship with each other, comprising:

compressing, purifying, and cooling air in a main heat exchanger having a warm end and a cold end, leading the cooled air to rectification, removing at least one nitrogen product fraction from the high pressure column;

removing a nitrogen gas fraction from the double column;

heating and expanding the nitrogen gas fraction;

at least partially bringing the nitrogen gas fraction into indirect heat exchange with an oxygen-enriched fluid from a lower region of the medium-pressure column;

at least partially condensing the nitrogen gas fraction, thereby forming a condensate and at least partially evaporating the oxygen-enriched liquid in the indirect heat exchange, at least partially feeding the condensate to the medium-pressure column, wherein the heating of the nitrogen gas fraction is upstream of the expanding and wherein the heating is to an intermediate temperature between the temperatures at the cold end and the warm end of the main heat exchanger.

2. The method according to claim 1, wherein the nitrogen gas fraction is not cooled between the heating to the intermediate temperature and expanding.

3. The method according to claim 1, wherein the nitrogen gas fraction is taken from the high-pressure column.

4. The method according to claim 1, wherein the nitrogen gas fraction is not compressed between heating to the intermediate temperature and expanding.

5. The method according to claim 1, wherein a part of the condensate is fed to the high-pressure column.

6. The method according to claim 1, wherein the expanding of the nitrogen gas fraction is accomplished in a work-producing manner.

7. The method according to claim 6, wherein energy obtained during the expanding is used at least partially to compress a product stream.

8. The method according to claim 1, further comprising condensing a part of the expanded nitrogen gas fraction in indirect heat exchange with an intermediate liquid from the medium-pressure column.

9. A device for obtaining nitrogen by low-temperature separation of air, comprising:

a double column having a high-pressure column and a medium-pressure column, wherein the double column is connected to a main heat exchanger, the main heat exchanger comprising passages for compressed, purified air and passages for separation products and having a warm end and a cold end;

a nitrogen product line connected to the high-pressure column;

an expansion machine;

a condenser-evaporator having a liquefaction chamber and an evaporation chamber;

a nitrogen gas line that leads from the double column to the main heat exchanger, leaves the main heat exchanger at an intermediate region between the cold end and the warm end of the main heat exchanger, and leads from the expansion machine into the liquefaction chamber;

a line for oxygen-enriched fluid that leads from a lower region of the medium-pressure column to the evaporation chamber;

a condensate line that leads from the evaporation chamber to the medium-pressure column.

10. The device according to claim 9, wherein the nitrogen gas line between the main heat exchanger and the expansion machine has no means for changing the temperature.

11. The device according to claim 9, wherein the nitrogen gas line is connected upstream of the main heat exchanger to the high-pressure column.

12. The device according to claim 9, further comprising:

a branch line connected to the nitrogen gas line between the expansion machine and the condenser-evaporator, wherein the branch line leads to a liquefaction chamber of a second condenser-evaporator, wherein an evaporation chamber of the second condenser-evaporator is connected to an intermediate region of the medium-pressure column.

13. The device according to claim 10, wherein the nitrogen gas line between the main heat exchanger and the expansion machine has no means for changing the pressure.

* * * * *